US006823861B1

(12) United States Patent
Ragan et al.

(10) Patent No.: US 6,823,861 B1
(45) Date of Patent: Nov. 30, 2004

(54) SELF CONTAINED POND HEATER

(76) Inventors: Kenneth Ragan, Rte. 3, Box 3380, Thayer, MO (US) 65791; C. Dale Rogers, 111 N. 9th, Thayer, MO (US) 65791

( * ) Notice: Subject to any disclaimer, the term of this patent is extended or adjusted under 35 U.S.C. 154(b) by 0 days.

(21) Appl. No.: 10/661,176

(22) Filed: Sep. 15, 2003

(51) Int. Cl.[7] ..... F24H 1/00

(52) U.S. Cl. ..... 126/360.1; 126/376.1; 126/367.1; 126/271.1

(58) Field of Search ..... 126/360.1, 376.1, 126/367.1, 271.1, 373.1, 85 R, 566, 568

(56) References Cited

U.S. PATENT DOCUMENTS 2,211,171 A * 8/1940 Self ..... 210/120
2,345,400 A * 3/1944 Laughead et al. ..... 119/73
2,430,165 A * 11/1947 Fine ..... 119/73
2,512,934 A * 6/1950 Hancock ..... 126/360.1
2,556,984 A * 6/1951 Smith ..... 126/360.1
2,709,408 A * 5/1955 Orshansky, Jr. ..... 74/836
3,051,162 A * 8/1962 Porter ..... 126/376.1
4,425,902 A * 1/1984 Thouault et al. ..... 126/360.1
4,505,254 A * 3/1985 Wigdahl ..... 126/367.1
5,105,799 A * 4/1992 Wigdahl ..... 126/210
6,597,863 B2 * 7/2003 Koskey, Jr. ..... 392/499

* cited by examiner

*Primary Examiner*—Jiping Lu
(74) *Attorney, Agent, or Firm*—Dennis B. Haase

(57) ABSTRACT

A wholly self-contained pond heater for use in preventing ice from forming on a pasture pond, comprising a heater assembly secured in a casing which is partially submersible in the pond. The heater assembly has a fire box from which intake and exhaust stacks extend upwardly. The stacks terminate in tips which face one another. The casing has louvers for the movement of air into and out of the casing, and an LPG fuel supply provided on the casing and connected to the heater assembly.

12 Claims, 2 Drawing Sheets

SELF CONTAINED POND HEATER

The present invention relates generally to pond heaters for use in preventing livestock water supplies from freezing over in cold weather and, more particularly, to such heaters which are entirely self contained.

BACKGROUND OF THE INVENTION

1. Field of the Invention

The agricultural community is clearly an integral part of the economy. Within that community is the farmer who raises livestock for both meat and milk. To such farmers, the health and well being of his or her livestock is at the root of their existence.

Such enterprises are not found entirely in the grassy climes of the Southwest. Indeed, the rancher is found wherever the market exists, and that may be in Wisconsin, which is famous as a dairy state, as well as other Northern states. Such states routinely experience freezing temperatures, and, even in Missouri and the Carolinas, freezing temperatures are a concern to the farmer/rancher because his herd lives outside in the weather. Irrespective of the temperature or the geographic location, animal herds need water for their very existence and, obviously, if the water source is frozen over, the herds that depend on that water suffer and even die.

While years ago the farmer/rancher would go out to the pond, or other water source, and literally break the ice which covered it, such effort was often an exercise in frustration because, depending on the weather, the ice would quickly reform, and the cycle would repeat itself over and over again.

What was needed, of course, was some way to keep ice from forming on a water source. However, unless the source was a water tank in proximity to a power source, the task was daunting. The reality is that, at least as to those water sources which are natural, e.g., a pond out in the pasture, ingenuity was required to achieve the desired result. Enter the pond heater.

2. Overview of the Prior Art

Since at least the end of WWII, man has attempted to create a pond heater which would stabilize a natural water source by preventing the surface from being frozen over. Such an early attempt is found in Hancock U.S. Pat. No. 2,512,934 wherein a 55 gallon drum of fuel, presumably oil, is attached to a burner, and the combination placed on skids and partially submerged in a water source, which will be referred to, cumulatively, as a pond for simplicity.

The Hancock unit was fraught with problems. It had to be carefully positioned in the pond so as to be horizontal. It had to be lighted and kept lit, and it was highly susceptible to being damaged by inadvertent contact with livestock attempting to get water, just to name a few.

Tibbits, in his U.S. Pat. No. 2,709,408, suggests the placement of a gas heater in a cylinder to heat water within that cylinder. An external gas source is required to feed the heater through conduit 34. A supporting frame is required to stabilize the heater, but there is the ever present danger of the conduit being severed, and/or the heater being tipped over by an anxious animal, and where there are several animals all trying to fit into a small space to get water, the danger is magnified.

Porter, in his U.S. Pat. No. 3,051,162, suggests a submersible heater within a conventional watering tank and an external fuel supply. Similarly, Thousault, et al., in their U.S. Pat. No. 4,425,902 suggests a submersible heater for industrial liquids, and Laugh at et al. U.S. Pat. No. 2,345,400 teaches a sled having a combined heater and enclosed tank for water. Fine U.S. Pat. No. 2,430,165 espouses a similar approach.

Casc has caused his application to be published at US 2002/0136545, and it relates to an electric heater with a very long extension cord. It appears to have commercial appeal in that it is being offered commercially on the Internet by K&H Manufacturing. The external connection creates some very practical problems, especially for use out in a pasture well away from an electrical source.

SUMMARY OF THE INVENTION

The prior art chronicled above presents a veritable litany of significant practical problems for the farmer/rancher who wants to avoid the necessity of watching his watering pond to be sure that it is kept free of ice. It is to the existence of these problems that the pond heater of the present invention is addressed.

Specifically, the present invention teaches a self contained liquid or gas fueled pond heater which is devoid of external connections, partially submersible, and highly efficient, so much so as to be affordable even by the small rancher.

Among the objectives to be accomplished by the present invention is the provision of a pond heater having the foregoing characteristics and which is not readily capsized by livestock moving about it. A further objective is to provide such a pond heater which will remain fired, despite being jostled by livestock, and even in the strong winds commonly experienced in the more open venues.

Yet another objective of the present invention is to provide a pond heater which is exceptionally compact and, thus, easily handled by the farmer/rancher, while at the same time, once lit, being sufficiently powerful as to create an area about it which is free of ice and, due to the efficient nature of the device, will maintain the ice free area for several days at a time.

The foregoing, as well as other objectives and advantages of the pond heater of the present invention, will become evident from a reading of the following Detailed Description of a Preferred Embodiment, when taken in conjunction with the drawings, wherein:

DETAILED DESCRIPTION OF A PREFERRED EMBODIMENT

Figure 1:
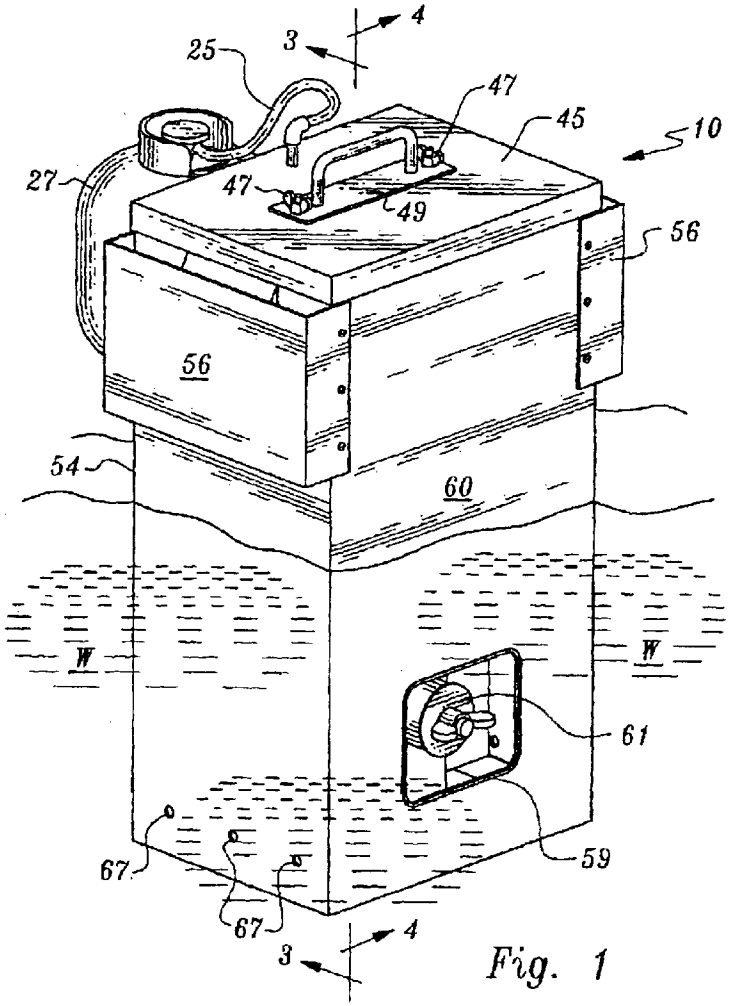
FIG. 1 is a perspective view of a pond heater constructed in accordance with the present invention and shown as it would appear in a typical pond setting.
Figure 4:
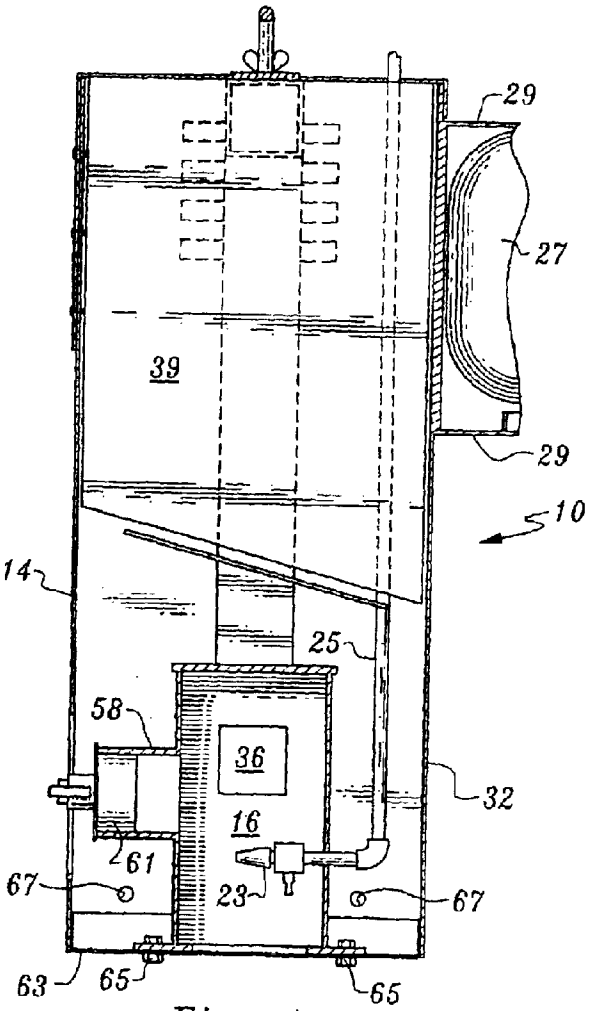
Figure 3:
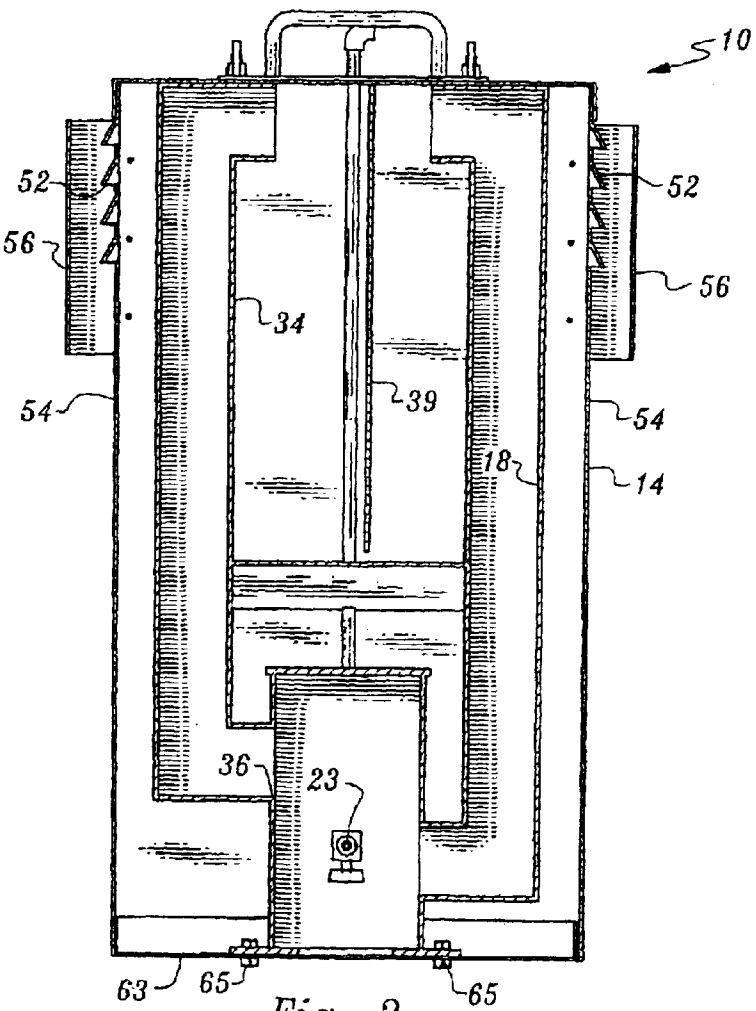
FIG. 3 is a sectional view of the pond heater of FIG. 1, taken along lines 3—3 of FIG. 1; and, FIG. 4 is a sectional view of the pond heater of FIG. 1, taken along line 4—4 thereof.

With reference now to the drawings, and initially to FIG. 1, a novel pond heater constructed in accordance with the present invention is illustrated at 10 and is secured in a body of water which will hereinafter be referred to as a pond.

Figure 2:
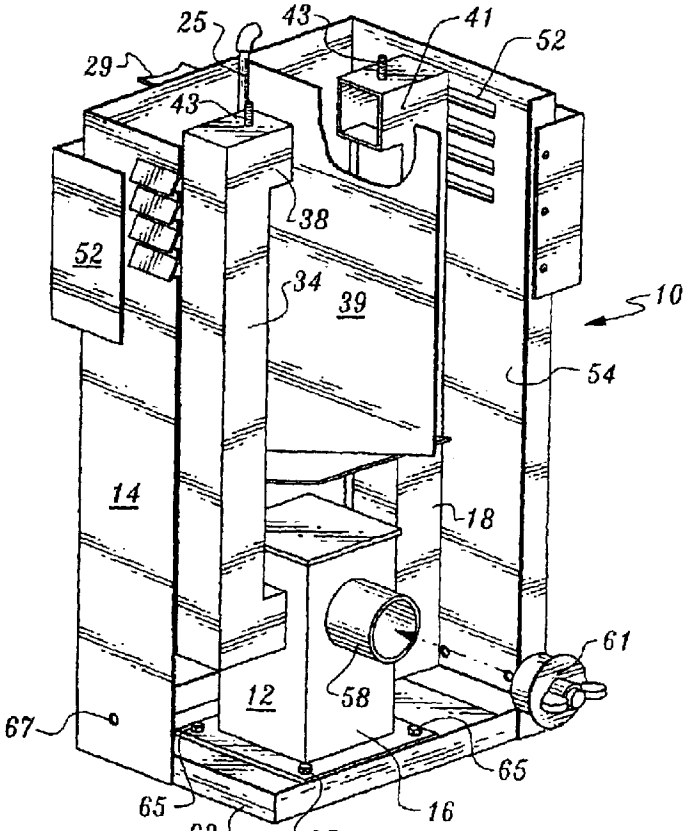
FIG. 2 is a view of the pond heater of FIG. 1 with a portion of the external casing cut away in order to permit the heater unit to be shown.

A heater assembly 12 (FIG. 2) is secured in, and circumscribed by, a casing 14, which, in the illustrated case, is rectangular in configuration, although other casing shapes are within the contemplation of the invention.

The heater assembly 12, in accordance with the invention, includes a heater element in the nature of a fire box 16; an intake manifold 18 is provided and is in the form of an upstanding tube which opens at one end into the firebox 16 at throat 21 immediately adjacent to the burner to provide intake air to a burner 23. The intake manifold is contained within the casing as a means of protecting the heater assembly from being subjected to foreign substances, e.g., particulate matter. The open end of the intake manifold is disposed considerably above, and remote from the firebox.

The heater assembly further includes an exhaust stack comprising an upstanding tube 34. The exhaust stack 34 opens into the firebox at 36, well above and remote from the burner, in order that gaseous byproducts of combustion, which will migrate upwardly, are easily and efficiently withdrawn from the firebox. In order to facilitate creation of a slight negative pressure, and, thus, a draft on the exhaust stack 34, a right angle tip 38 is provided. The tip opens inwardly in order to avoid possible turbulence from air currents in immediate proximity which could adversely effect combustion at the burner under windy conditions, which are not uncommon in pastureland.

In a similar fashion, and for similar reasons, the intake manifold is tipped as at 41 and faced inwardly in the general direction of the exhaust stack. In order to inhibit exhaust gasses from being inadvertently sucked into the intake, a baffle 39 is interposed between the exhaust and intake stacks, thereby assuring that intake air is contaminated by only minimal exhaust fumes.

The exhaust stack and the intake manifold are provided with fasteners 43. The fasteners project through openings in the cap 45, where they are secured by wing nuts 47. The wing nuts, coincidently, secure a plate and handle assembly 49, which provide a convenient means of manually moving the pond heater 10 from place to place.

It is an important feature of the heater of the present invention that it is entirely self contained. Self containment means to the farmer that livestock and humans alike will not become entangled in cords, lines, pipes, conduit and the like. Moreover, portability and selective strategic placement is readily achieved.

As a means of accomplishing this objective of self containment, the burner is preferably of a liquid fuel type, Liquified Petroleum Gas being the preferred fuel. An LPG fuel line 25 is provided and feeds fuel to the burner 23 from a fuel supply tank 27 in close proximity to the burner. The fuel tank 27 is conveniently mounted directly to the casing 14 by means of "C" type clamps 29, which are secured in any well known manner to a back panel 32 of the casing 14. It will be appreciated that other modes of attachment may be used without departure from the invention.

An adequate air supply is vital to the efficiency of the heater. It is understood, however, that wind conditions on pasture land where such ponds are located, are unpredictable due to the openness. In order to avoid inadvertent blowout of the heater's burner due to wind swirling about the heater 10, an air supply is provided within the casing, but controlled by the provision of louvers 52 in the side walls 54. Air supply to the intake manifold 18 is further controlled by deflectors 56 secured about the louvers in order to prevent wind from directly impinging on and through the louvers 52.

In order to permit the farmer/rancher to easily light the burner, a pilot pipe 58 is provided. A water tight cap 61 is removably affixed over the pipe 58. An access opening 59 is provided in the forward panel 60. The burner is readily ignited by inserting an igniter into the pipe with the gas supply turned on.

It will be appreciated that there are battery operated igniters readily available on the market, any one of which would be suitable for this purpose. It is also known that the technology to cause the burner to be automatically ignited upon the surrounding pond water reaching a predetermined temperature, is available. The cost of such technology, however, makes its implementation in this environment prohibitive to many farmer/ranchers.

The heater assembly is secured to the base plate 63 by any well known manner such as fasteners 65, and a series of apertures 67 permit pond water W to enter the casing 14, below the water line, when the pond heater 10 is in place. Once the heater assembly 12 is lit, that water, together with water in the immediate vicinity, will be heated, and an ice free zone is, thus, created about the perimeter of the pond heater for an appropriate radius, which is dependent on the amount of heat generated by the heater assembly.

Since it is not at all desirable for cattle, by virtue of their hooves, to be wading out into the pond to get water, or to permit ice to form between the shore and the heater, the heater is necessarily positioned close to shore. Since most pasture ponds are shallow near the shore, the pond heater is readily secured to the pond bottom, such as, for example, by steel fence posts found on most farms, not specifically shown here, with a portion of the pond heater submersed such that water completely circumscribes the firebox 16, thereby achieving the goals attributable to it.

Having described a preferred embodiment of our invention, and with the understanding that some variation in the several elements of our heater is within the contemplation of the invention, we claim:

What is claimed is:

1. A self contained pond heater, said pond heater having a heater assembly, said heater assembly being water tight;

said heater assembly comprising a fire box, a gas fired burner in said fire box;

said heater assembly further including an intake manifold secured to said fire box for introducing air at said burner, said intake manifold comprising an elongated tube;

an exhaust stack, said exhaust stack attached to said fire box to remove exhaust gases therefrom, said exhaust stack comprising an elongated tube;

said casing circumscribing said heater assembly;

a fuel supply secured to said casing, and a fuel line connecting said burner to said fuel supply to supply fuel to said burner;

said pond heater being secured in a body of water, partially submerged therein so as to heat the water in the immediate vicinity thereof to inhibit the formation of ice on said pond.

2. The pond heater of claim 1, wherein said intake manifold and said exhaust stack are open at a position above and remote from said fire box.

3. The pond heater of claim 2, wherein said intake manifold and said exhaust stack are entirely within said casing, and said casing being provided with louvers adjacent each said intake manifold and said exhaust stack.

4. The pond heater of claim 2, wherein said casing is provided with apertures, said apertures being so positioned as to be below the water line when said pond heater is partially submerged, to thereby allow water from the pond to come into contact with said fire box.

5. The pond heater of claim 1, wherein said intake manifold and said exhaust stack are entirely within said casing, and said casing being provided with louvers adjacent each said intake manifold and said exhaust stack.

6. The pond heater of claim 5, said casing having deflectors secured thereto, said deflectors being disposed about said louvers to inhibit wind gusts from disrupting operation of said heater assembly.

7. The pond heater of claim 1, wherein said intake manifold and said exhaust stack, respectively, terminate in tips, said tips being angled to face one another in said casing.

8. The pond heater of claim 7, wherein said tips at the terminus of said intake manifold and said exhaust stack are at right angles and facing one another.

9. The pond heater of claim 8, wherein a baffle is provided between said tips to thereby inhibit exhaust gases from entering said intake manifold.

10. The pond heater of claim 1, wherein said casing is provided with apertures, said apertures being so positioned as to be below the water line when said pond heater is partially submerged, to thereby allow water from the pond to come into contact with said firebox.

11. The pond heater of claim 10, wherein access is provided in said casing for lighting said burner without removing said heater assembly from said casing.

12. The pond heater of claim 1, wherein access is provided in said casing for lighting said burner without removing said heater assembly from said casing.

* * * * *